United States Patent [19]

Steinmetz et al.

[11] 4,419,937

[45] Dec. 13, 1983

[54] MAGNET SUPPORTING FRAME FOR A MAGNETICALLY LEVITATED VEHICLE

[75] Inventors: Guenter Steinmetz, Bruckmuehl; Ulf Steenbeck, Putzbrunn; Dieter Reismayr, Oberhaching, all of Fed. Rep. of Germany

[73] Assignee: Messerschmitt-Boelkow-Blohm GmbH, Munich, Fed. Rep. of Germany

[21] Appl. No.: 284,701

[22] Filed: Jul. 20, 1981

[30] Foreign Application Priority Data

Sep. 5, 1980 [DE] Fed. Rep. of Germany ..... 3033448

[51] Int. Cl.[3] ..... B61B 13/08

[52] U.S. Cl. ..... 104/281; 104/284; 105/157 R

[58] Field of Search ..... 104/281, 282, 283, 284, 104/285, 286, 290, 291, 293; 105/206 A, 208 R, 157 R, 202, 208, 208.1, 208.2

[56] References Cited

U.S. PATENT DOCUMENTS 3,886,871 6/1975 Ross et al. ..... 105/157 R
3,913,493 10/1975 Maki et al. ..... 104/281
4,246,846 1/1981 Betschart ..... 104/134

FOREIGN PATENT DOCUMENTS 2511382 9/1976 Fed. Rep. of Germany .
53-18115 2/1978 Japan ..... 104/284
54-153417 12/1979 Japan ..... 105/157 R

*Primary Examiner*—Robert B. Reeves
*Assistant Examiner*—Richard Mathieu
*Attorney, Agent, or Firm*—W. G. Fasse; D. H. Kane, Jr.

[57] ABSTRACT

The levitating and guide magnets of a magnetically levitated vehicle are supported by frames. Each frame comprises two crossbeams (4) extending across the length of the rails. These crossbeams (4) are flexible against bending and connected in pairs in the longitudinal rail direction by connecting members which are stiff against shearing loads. Both, the levitating magnets (1) and the guide magnets (2) are supported in a see-saw fashion by respective journal shafts or pins (7, 7'). Each pair of crossbeams (4) carries four sets of magnets. Each set of magnets includes two levitating magnets (1) and two guide magnets (2) forming a respective structural magnet unit. The journal pins may be replaced by pivot movement permitting spring supports.

9 Claims, 5 Drawing Figures

MAGNET SUPPORTING FRAME FOR A MAGNETICALLY LEVITATED VEHICLE

CROSS-REFERENCE TO RELATED APPLICATION

The present invention corresponds to German patent application No. P 3,033,448.6; filed in the Federal Republic of Germany on Sept. 5, 1980. The priority of said German filing date is hereby claimed.

BACKGROUND OF THE INVENTION

The invention relates to a magnet supporting frame for a magnetically levitated vehicle. The magnets are electromagnets and their magnetic force is controlled by controlling the electrical energization of the magnet coils. The vehicle travels on a rail structure and the magnets are movably arranged in a frame secured to the vehicle so that the magnets are arranged in rows symmetrically to a plane extending vertically, longitudinally and centrally through the rail structure and hence also through the vehicle. The magnets are movable in the direction in which the magnetic forces are effective.

The magnets comprise levitation magnets and guide magnets. The electromagnetic attraction forces of these magnets are used to levitate and guide the vehicle whereby the rail structure operates as a back flow member to close the magnetic circuits. In order to keep the electrical input power within economically feasible limits, it is necessary to maintain suitable levitation and guide gaps between the magnets carried by the vehicle and the stationary rail structure. The gap width should be as small as possible preferably in the range of 5 to 15 millimeters. Maintaining such gap width for the desired levitational freedom involves two separate approaches. One approach relates to the closed loop or feedback control of the gap width. The other approach relates to the structural arrangement of the magnets. Both approaches must take into account criteria determined for a comfortable travel. The invention is directed to the structural arrangement of the magnets.

It is known in the art to support the magnets by means of springs for decoupling the electromagnets from the vehicle or from the frame carrying these magnets, in a vibratory sense. In other words, vibrations of the magnets must not affect the vehicle. Where a relatively large number of individual magnets are arranged in a row extending in the longitudinal direction of the vehicle, it is known to support these magnets individually by respective spring suspension means. Such individual spring suspension means have the drawback that any magnet may be individually subject to excursions to such an extent that the magnet contacts a rail, unless additional means are provided for individually guiding the movements of the magnets.

German Patent Publication (DE-OS) 2,633,647 discloses an effort for controlling such magnet excursions. Magnet tie down spring means are arranged so that the respective magnet is fettered to such an extent that the stabilizing moments resulting from an excursion, are larger than the moments which cause the magnet excursions in the first place. These tie down spring means also must satisfy predetermined stability criteria. However, such prior art tie down spring means cannot avoid that the respective magnet may take up a slanted position relative to a rail of the rail structure, even if the magnet is in a stable position relative to its frame, that is even when the magnet is not subject to an excursion. Such slanted magnet position relative to a rail may be due to positional faults in the rail structure. Under these circumstances there is a real danger that a magnet may impact on the rail becuase the magnetic forces of the electro-magnet are increasing as the gap or spacing between the magnet and the rail decreases. Thus, it has been preferred heretofore to use, in addition to the individual tie down spring means, a mechanical parallel guide for guiding the magnet relative to its frame.

However, it has been found that the gap width reduction and thus the reduction in the so-called levitational freedom which becomes posible due to the spring support means for the individual magnets on the one hand, becomes practically self defeating on the other hand due to unavoidable installation tolerances and deformations of the parallel or enforced guide means and of the magnet support frame as well as of the electromagnet itself. Stated differently, these factors make it practically impossible to maintain the desired gap width reduction which is intended to be achieved by the spring support means for the individual magnets especially if it is intended to normally avoid almost any contact between the magnets and the rail structure.

Further, it is inherent in the concept of individual spring supports for each magnet that a support base is required for the stabilization of each magnet. Such support base must be provided as a relatively stiff frame or chassis so that the spring means may become effective at all as a stabilizer or as an additional mechanical enforced guiding means. Consequently, and if one wants to minimize the structural weight of the magnet support frame, spring support means for each individual magnet should be avoided.

Thus, German Patent Publication (DE-OS) No. 2,837,191 does not solve the problem of adapting the position of the electromagnets to the rail course by arranging the electromagnets movable in the direction of the effect of the magnetic force on the support frame. Rather, this publication discloses a ligher, twistable construction of the magnet support frame. However, the frame according to this reference still has a larger stiffness against bending loads. The individual girders of the known frame are stiff against bending in order to be able to hold the respective electromagnet in a stable position, in other words to prevent it from performing angular movements in the pitching direction. Stated differently, the frame of DE-OS No. 2,837,191 permits, due to its twisting a position adaptation of the electromagnet to the rail course and the bending stiffness of the frame counteracts any destabilizing pitching movements of the magnet. Of course, such bending stiffness requires a substantial material investment, for example, in the form of profiled or sectional frame girders. Thus, the known frame does not constitute an optimal solution of the problem of minimizing the structural weight of the frame.

OBJECTS OF THE INVENTION

In view of the above it is the aim of the invention to achieve the following objects singly or in combination:

to construct a magnet support frame for levitated vehicles in such a manner that an optimal reduction of its structural weight is achieved;

to provide a lightweight magnet support frame which will, under normal operating conditions, prevent any magnet from contacting the respective rail;

to solve the problem of adapting the instantaneous magnet position to the rail course by means of a magnet support frame which is flexible in response to substantially vertically effective bending loads;

to compensate for tolerances in the gage of the rail structure by permitting the magnet support frame to spread so to speak laterally outwardly; and to minimize the gap width or the so-called levitational freedom by the lightweight construction of the magnet support frame.

SUMMARY OF THE INVENTION

According to the invention there is provided a magnet supporting frame for levitated vehicles in which pairs of structural magnet units located opposite each other, are interconnected by crossbeams which are flexible against bending. Each structural magnet unit comprises two individual magnets which are aligned in the longitudinal direction and contact each other at their end faces. The structural magnet units are independent of each other but are arranged symmetrically relative to a vertical central plane passing longitudinally through the vehicle and hence through the rail structure. Two crossbeams are interconnected in the longitudinal direction of the vehicle or rail structure by means of connecting members stiff against shear loads. The structural magnet units are pivotally supported or secured to the individual crossbeams for tilting about a pivot axis extending in parallel or rather coinciding with the pitch axis of the respective structural magnet unit. The pivotal connecting may be accomplished by means of journal pins or by means of a central spring support structure secured to a point, so to speak, of the respective structural magnet unit.

The advantages of the frame according to the invention are seen in that it has a small stiffness against twisting or torque loads, just as the structure according to German Patent Publication (DE-OS) No. 2,837,191. Additionally, the present structure has the advantage that it does not need to have any bending or shearing stiffness as far as the pitching stabilization of the electromagnets is concerned. This advantage is due to the see-saw type of support for the individual structural magnet units. Such support greatly facilitates the closed loop control of the angular or pitching movements of each structural magnet unit through the current supply for the two individual magnets forming the unit. For all practical purposes the present frame may be dimensioned solely with regard to its strength criteria in accordance with given load requirements. This advantage in turn leads to a substantial weight reduction as compared to the prior art structure.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
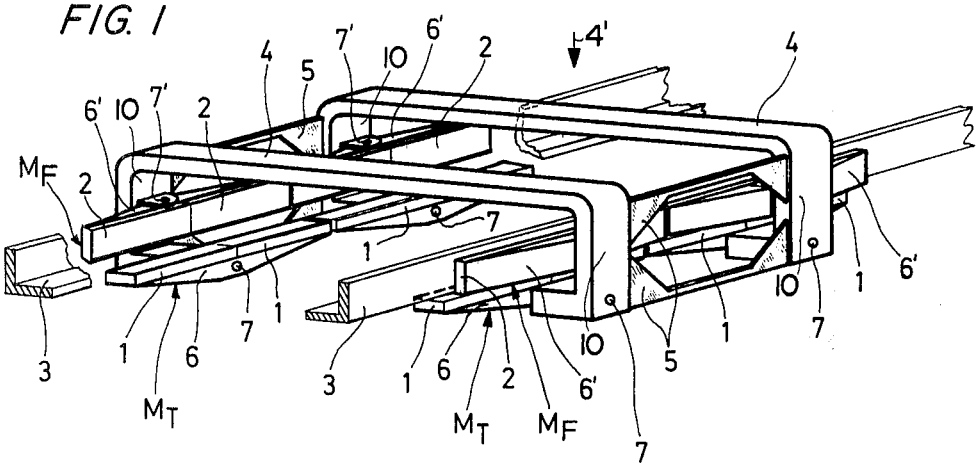
FIG. 1 is a perspective view of a magnet support frame according to the invention.

The perspective view of FIG. 1 shows the magnet supporting frame for a levitation vehicle which itself is not illustrated. Each frame carries four structural magnet units MT for levitation and four structural magnet units MF for guiding. Each levitation magnet unit MT comprises two levitation magnets 1 secured in a longitudinal alignment with each other to a support member 6. Each structural unit MT is tiltable about a journal pin 7 extending horizontally. Each of the four further structural guide magnet units MF comprises two guide magnets 2 secured to a support member 6' tiltable about a vertical journal pin 7'. The guide magnets 2 are also located in longitudinal alignment. The members of each pair of magnets 1 and 2 contact each other at the facing ends in a common plane 11.

Two stationary rails 3 (the left one to be imagined as transparent), extending in parallel to each other from a rail structure and serve simultaneously as armature means for the magnets 1 and 2 which levitate and guide a vehicle along the rail structure or track. Depending on the length of the vehicle, several such frames may support the vehicle structure or body. For example, one frame may be located at each end of a vehicle.

The frame according to the invention constitutes a force transmitting or force conducting connecting element between the vehicle structure and the levitation magnets 1, the guide magnets 2 as well as any other components such as drive means and emergency levitation and guide means. Therefore, the structural strength of a frame according to the invention is determined solely by these loads and not by any conventional considerations for the gap width minimization. Hence, each frame comprises but two bending crossbeams 4 so constructed and arranged that their resistance against a vertically effective bending load is minimal, whereby these crossbeams 4 are flexible by said bending loads vertically effective in the direction of the arrow 4'. The ends of each crossbeam 4 are formed as bails having a C-shape or a U-shape whereby the lateral legs 10 of the C- or U-shaped bails reach at least partially around the armature rails 3. The bending crossbeams 4 forming a pair are secured to each other by a plurality of connecting members 5 extending longitudinally relative to the rails 3 and, for example, welded to the crossbeams 4. The members 5 are resistant to shearing loads to make sure that the crossbeams 4 cannot make any angular movements in the longitudinal rail or vehicle direction while still being able to bend in a vertical plane. The shearing resistant members 5 are preferably secured to the lateral legs 10 of the crossbeams 4. The structural magnet units MT and MF are the only components which are stiff against bending loads due to the supports 6, 6' each carrying a pair of magnets as described. Due to the C- or U-shape of the crossbeams these magnets face each other in pairs across the rails 3.

As best seen in FIG. 1 the bending crossbeams 4 have a rectangular cross-section so arranged that the larger flat sides extend horizontally to offer said minimal resistance to said bending load, whereby the described structure of the present frame is capable of twisting movements to any extent that may be required for adapting the position of the magnet units MT, MF to the course of the track.

The bending stiff supports 6, 6' pivot or pitch about the respective pivot or journal axis 7, 7' in a see-saw fashion. Thus, it is assured that the respective magnet units MT, MF are able to perform freely any required angular movement about their respective axis of rotation extending in parallel or rather coaxially with the respective pitch axis. The rotational axis preferably extends centrally across the respective unit thus forming a central cross axis.

The ability of the magnet units MT, MF to pivot or pitch freely about the respective central cross axis 7, 7' has the advantage that the angular movement of the individual units in the pitching direction may be controlled by controlling in closed loop fashion the excitation of the respective electromagnets 1 and 2 located on either side of the central cross axis. This closed loop control may be such that the respective unit maintains a stable position in which the longitudinal axis of the unit extends in parallel to the respective rail. Thus, an impact contact between the units MT, MF and the rail 3, due to uncontrolled pitching of these units is avoided. As a result, the respective frame or crossbeam 4 does not need to provide a support function and hence may be flexible against bending loads as taught herein.

Another advantage of the invention is seen in that any gage tolerances in the structure of the rails 3 are easily compensated by the bending of the crossbeams 4 whereby the lags 10 are spread apart laterally in a direction across the rails 3. Such spreading in combination with the location of the magnet units at the ends of the crossbeams 4 not only provides said compensation of gage tolerances, it also makes possible to actively guide the magnet units in the essential degrees of freedom relative to the rails 3. Such active guiding involves magnet movements in a direction normal to the rail and angular movements in the pitching direction. This controllability in turn results in optimally reducing the above mentioned gap width between the units MT, MF and the rails 3 and hence the so-called levitational freedom.

The current control of the individual magnets 1, 2 or of the magnet units MT, MF may be accomplished conventionally, for example, as disclosed in German Patent Application P No. 3,010,102.1.

The vehicle structure may be supported on the frames 4, 5 by means of conventional air springs including roll stabilizers. The force flow or transmission for the drive and brake forces in the longitudinal vehicle direction may be accomplished by means of conventional guide rods.

Figure 2:
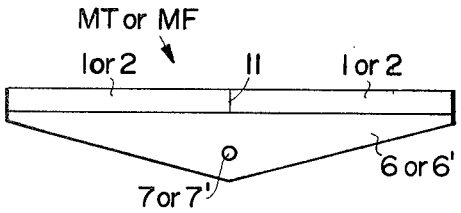
FIG. 2 is a side view of a structural magnet unit having a journal axis which coincides with its pitching axis.

FIG. 2 shows a magnet unit MT or MF having a bending stiff support 6, 6' carrying two of the respective magnets 1 or 2 lontitudinally aligned and contacting each other at the ends in a common plane 11. The pivoting or journal axis 7, 7' coincides with the pitching axis of the unit. The magnets are secured to the support by conventional means such as threaded bolts not shown.

Figure 3:
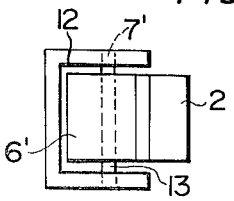
FIG. 3 shows a bracket for journalling a structural magnet unit.

FIG. 3 shows a side view of a magnet unit MF held in a bracket 12 which is in turn secured to the rail facing side of the respective leg 10 of the crossbeam 4, for example, by welding or the like. The bracket 12 holds the pivot or journal pin 13 vertically while the pivot or journal axis 7 extends horizontally as shown in FIG. 1.

Figure 4:
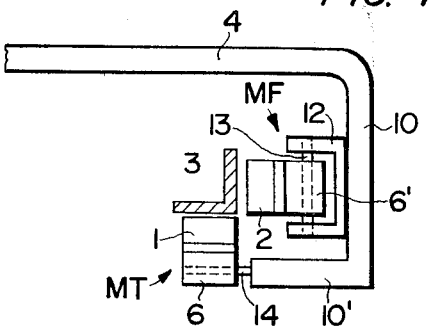
FIG. 4 is a side view of one end of a crossbeam according to the invention with two structural magnet units journalled thereto.

FIG. 4 shows a side view of the right-hand end of a crossbeam 4 with the units MT and MF shown in the position relative to each other and relative to the respective rail 3. The pivot or journal pin 14 is secured to a horizontal extension 10' of the leg 10 of the crossbeam 4.

Figure 5:
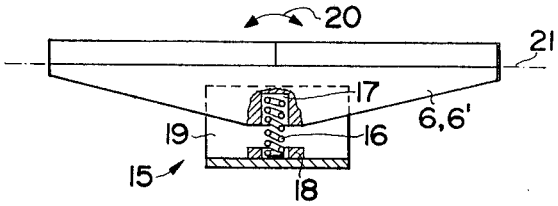
FIG. 5 is a side view similar to FIG. 1, but showing a central spring support which permits a pivoting movement of the structural magnet unit.

FIG. 5 shows pivot means 15 in the form of a spring support comprising a coil spring 16 operatively held in a socket 17 in a support 6, 6' and in a socket 18 of a guide bracket 19. The bracket 19 prevents lateral excursions of the respective magnet unit but permits pivot movements in the pitching direction 20. This structure further reduces the magnet masses that must be controlled. The bracket 19 provides the required roll control against roll movements about the longitudinal axis 21 since the support 6, 6' is slidably received between the legs of the bracket 19. Roll control may also be achieved by a parallel guide rod arrangement as described in German Patent Application P No. 3,010,102.1.

Although the invention has been described with reference to specific example embodiments it is to be appreciated, that it is intended to cover all modifications and equivalents within the scope of the appended claims.

What is claimed is:

1. A magnet supporting frame for a magnetically levitated vehicle movable on a rail structure defining a longitudinal direction, comprising at least two bending crossbeams (4) so constructed and arranged that their resistance against a substantially vertically effective bending load is minimal, whereby said bending crossbeams are flexible by said bending loads, said bending beams extending across the longitudinal direction of the rail structure, a plurality of connecting brackets (5) stiff against shearing loads and extending in parallel to said longitudinal direction interconnecting said at least two bending crossbeams (4) for forming said frame, levitating magnet means (1), first see-saw support means (6') for said levitating magnet means (1) including first pivot means (7) for tiltably securing said levitating magnet means to said bending crossbeams, guide magnet means (2), second see-saw support means (6') for said guide magnet means (2) including second pivot means (7') for tiltably securing said guide magnet means also to said bending crossbeams (4) so that each of said magnet means is tiltable in the direction of its respective magnetic force about an axis parallel to its pitch axis, whereby the magnet means are arranged in rows on both sides of a central plane extending vertically and centrally in said longitudinal direction, said rows extending symmetrically relative to said central plane.

2. The frame of claim 1, wherein said magnet means are arranged in groups, each group comprising two levitation magnets (1) having a common, horizontally extending pitch axis coinciding with the respective first pivot means (7) and two guide magnets (2) having a common, vertically extending pitch axis coinciding with the respective second pivot means (7'), said group being arranged mirror-symetrically relative to said central plane whereby one group is secured to each end of said crossbeams.

3. The frame of claim 2, wherein said two levitation magnets and said two guide magnets form respective structural units in which the corresponding two magnets are longitudinally aligned with each other, and face each other in a common plane, and wherein the respective pitch axis (7 7') extends in said common plane, so that the pitch axis forms a rotational axis which is a central cross axis.

4. The frame of claim 3, wherein each of said structural units comprises one of said see-saw support means (6, 6') so that each see-saw support means carries the respective two magnets, said see-saw support means being stiff against bending loads.

5. The frame of claim 1, or 2, or 3, or 4, wherein each of said crossbeams is formed as a bail at each end so that each bail end reaches at least partially around a respective rail of said rail structure.

6. The frame of claim 5, further comprising means operatively securing said first and second pivot means to the respective bail end of the respective crossbeam.

7. The frame of claim 1, wherein said first and second pivot means comprise journal pins operatively secured to the respective crossbeam for permitting a tilting or pitching movement of the respective magnet means.

8. The frame of claim 1, wherein said first and second pivot means comprise central spring means operatively secured to said magnet means and to the respective crossbeam for permitting a tilting or pitching movement of the respective magnet means and translations of the magnet means in their force direction relative to the crossbeam.

9. The frame of claim 1, wherein each of said bending crossbeams (4) has a rectangular cross-section with two long sides and two short sides, said long sides extending horizontally for offering said minimal resistance to said substantially vertically effective bending load.

* * * * *